United States Patent [19]

Vuilleumier

[11] 4,320,483

[45] Mar. 16, 1982

[54] ATTACHING DEVICE OF A DIAL ON STATIONARY PARTS OF A TIMEPIECE MOVEMENT

[75] Inventor: Cyril Vuilleumier, Bienne, Switzerland

[73] Assignee: Societe Suisse pour l'Industrie Horlogere Management Services S.A., Bienne, Switzerland

[21] Appl. No.: 28,284

[22] Filed: Apr. 9, 1979

[51] Int. Cl.[3] ..... G04B 19/06

[52] U.S. Cl. ..... 368/236

[58] Field of Search ..... 58/53–56, 58/88 R, 88 G, 91, 92–94, 95 R, 104, 127 R, 127 B, 1 M; 29/807; 40/156; 368/276, 280, 293, 223, 228, 232, 236; 248/206 A, 115

[56] References Cited

U.S. PATENT DOCUMENTS

| | | | |
|---|---|---|---|
| 1,594,527 | 8/1926 | Hunter | 368/220 |
| 1,624,741 | 4/1927 | Leppke et al. | 248/206 A |
| 2,953,970 | 9/1960 | Maynard | 248/206 A |
| 3,416,761 | 12/1968 | Shanok et al. | 248/115 |
| 4,058,335 | 11/1977 | Abe | 248/206 A |

FOREIGN PATENT DOCUMENTS

| | | | |
|---|---|---|---|
| 2365010 | 7/1974 | Fed. Rep. of Germany | 58/127 R |
| 2538803 | 3/1977 | Fed. Rep. of Germany | 58/91 |

*Primary Examiner*—Vit W. Miska

*Attorney, Agent, or Firm*—Griffin, Branigan & Butler

[57] ABSTRACT

To attach the dial to the timepiece movement it is proposed to use a magnetic circuit comprising at least one permanent magnet which cooperates with a soft ferromagnetic material. The latter may be a component of the dial while the magnet is placed within the movement. The magnetic attraction which exists between both elements holds together the dial and the movement.

5 Claims, 3 Drawing Figures

ATTACHING DEVICE OF A DIAL ON STATIONARY PARTS OF A TIMEPIECE MOVEMENT

BACKGROUND OF THE INVENTION

The present invention relates to an attaching device for a dial to stationary parts of a timepiece movement.

Several similar devices have been previously proposed. Generally, the dial is provided with dial-feet which are soldered to the lower side of the dial and are embedded in the bottom plate in which they are fixed.

In a wellknown arrangement the dial-feet are freely inserted in the corresponding openings of the plate. A screw at the side, held by the plate, enters a notch in the foot to lock it in position. In this case, the threading necessary in the plate in order to retain the screws and the screws themselves take up a relatively important space. To obviate this disadvantage it has been proposed to suppress the screws and to replace them by sleeves used to guide and to squeeze elastically the dial-feet. In such embodiment it will be understood that feet and sleeves also employ a non negligible space which could be used more advantageously for other components of the timepiece. Moreover, in both cases the risk exists, when the dial-feet are inserted into their beds, to imprint moon-shaped marks on the visible side of the dial.

SUMMARY OF THE INVENTION

The present invention proposes to overcome these problems through the utilisation of a new attaching device based on the magnetic attraction of two elements, the first being attached to the dial and the second placed within the bottom plate.

A further object of the invention is to reduce overall thickness.

Still a further object of the invention is to insure a large flexibility in the choice of the location where the dial may be fixed leaving a free field for the important components of the movement.

Still another object of the invention is to simplify the mounting of the dial in order to reduce assembly time.

DETAILED DESCRIPTION OF THE INVENTION

Figure 1:
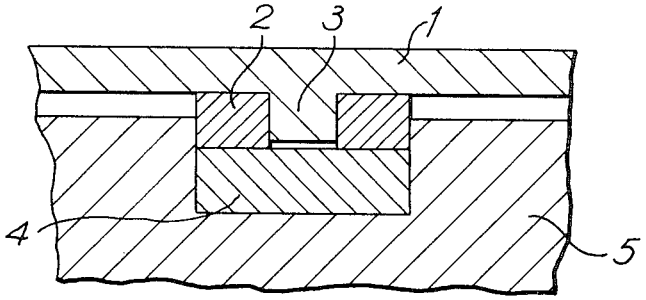
FIGS. 1, 2 and 3 are sectional views which show three different embodiments according to the invention.

In FIG. 1 a magnetisable element 2 (soft ferromagnetic material) is fixed to the dial 1 which is provided with a dial-foot 3. The magnetisable element is glued or force fitted to the dial-foot. Beneath the element 2 is located a permanent magnet 4 glued or set into a bed of the bottom plate 5. As the element 2 and the magnet 4 approach one another, they constitute a magnetic circuit and the attractive force of one element to the other attaches the dial to the plate.

Figure 2:
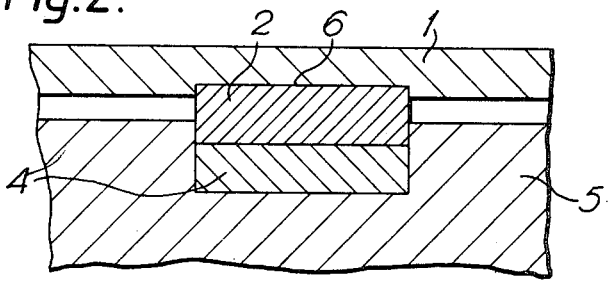

FIG. 2 shows another embodiment according to the invention. The magnetisable element 2 is glued or brazed in a bed 6 made on the underface of the dial 1. As in the construction shown in FIG. 1, the element 2 cooperates with a permanent magnet 4 fixed in the bottom plate 5. In this embodiment the magnetisable element may be replaced, in a further arrangement, by a second permanent magnet the direction of magnetization of said magnets being such as to effect attraction therebetween thus increasing the attractive force between both parts. In this same embodiment, the element 2 may be merely glued on the underface of the dial without bed 6.

In the above-mentioned construction it will be appreciated that the magnetic circuit constituted by the elements 2 and 4 is used not only to fix the dial on the plate, but also to guide and to centre the dial relative to the bottom plate.

Figure 3:
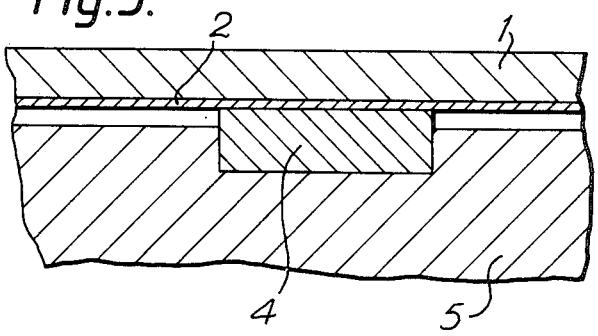

FIG. 3 shows still another embodiment according to the invention. The element 2 is a magnetisable sheet laminated or glued on the underface of the dial 1. It cooperates with a magnet 4 fixed into the bottom plate 5. In this embodiment the dial may be wholly realized with magnetisable material which would avoid the laminated or glued sheet provided previously. In this third embodiment the attaching device is no longer used as centring means for the dial on the bottom plate, therefore, it will be necessary to provide centring pins.

In the attaching devices according to the invention, the place and the number of attaching points are determined by the mechanism and the geometry of the timepiece. They may be located at the periphery of the dial as well as as its centre, in a crownshaped part surrounding the central axis or still on irregular shaped areas left free by the mechanism.

The permanent magnet making part of the magnetic circuit will be dimensioned and chosen to insure a sufficient attaching force. If B is the magnetic induction in gauss, A the contact area between magnet and magnetisable part in $cm^2$ and F the attractive force in kg, the relation $F=B^2A/8\pi\cdot10^6$ applies. If it is not possible to have a large contact area, a magnet with high energy product should be chosen to obtain a suitable attaching force.

The invention is not limited to the description and the drawings. It extends to all devices using a magnetic circuit and at least a permanent magnet in order to attach the dial and the bottom plate of a timepiece as defined by the claims.

What we claim is:

1. An attaching device for attaching a dial to a timepiece movement bottom plate comprising at least one magnetic circuit having at least a permanent magnet, said magnet circuit comprising a first element fixed to the dial and a second element fixed to the movement, one of said elements being said permanent magnet, said elements being arranged and adapted to obtain a magnetic attraction therebetween.

2. An attaching device as set forth in claim 1 wherein the first element comprises a magnetisable material glued or brazed to the underface of the dial and the second element comprises said permanent magnet glued or set into the movement bottom plate.

3. An attaching device as set forth in claim 2 wherein the first element comprises a sheet of material coextensive with the underface of the dial.

4. An attaching device as set forth in claim 1 wherein said first element is constituted by the dial formed entirely of magnetisable material and the second element comprises a permanent magnet glued or set into the movement bottom plate.

5. An attaching device as set forth in claim 1 wherein the first element comprises a first permanent magnet fixed to the underface of the dial and the second element comprises a second permanent magnet glued or set into the movement bottom plate, the direction of magnetization of said magnets being such as to effect attraction therebetween.

* * * * *